US005277682A

United States Patent [19]

Chen

[11] Patent Number: 5,277,682

[45] Date of Patent: Jan. 11, 1994

[54] RETARDING DEVICE FOR AN EXERCISER

[76] Inventor: Ping Chen, No. 20, Nan-Mei St., Taichung City, Taiwan

[21] Appl. No.: 51,640

[22] Filed: Apr. 22, 1993

[51] Int. Cl.[5] ..... A63B 21/012

[52] U.S. Cl. ..... 482/114; 482/113; 188/129

[58] Field of Search ..... 482/120, 119, 118, 117, 482/116, 115, 114, 113, 112, 73, 59, 58, 53; 188/129; 267/196

[56] References Cited

U.S. PATENT DOCUMENTS

| | | | |
|---|---|---|---|
| 1,707,791 | 4/1929 | Anderson | 482/114 X |
| 2,621,043 | 12/1952 | Olmstead | 482/114 |
| 2,966,321 | 12/1960 | Blattner | 188/129 X |
| 3,811,672 | 5/1974 | Simmons | 482/114 |
| 3,971,255 | 7/1976 | Yarnet et al. | 482/114 |
| 4,385,760 | 5/1983 | Mattox et al. | 482/114 |
| 4,469,325 | 9/1984 | Ware | 482/114 X |
| 4,606,442 | 8/1986 | Paton et al. | 188/129 X |
| 4,613,114 | 9/1986 | Paton | 188/129 X |
| 4,699,376 | 10/1987 | Mattox et al. | 482/114 |
| 4,738,437 | 4/1988 | Paton et al. | 188/129 X |
| 4,822,028 | 4/1989 | McLellan et al. | 482/114 |

*Primary Examiner*—Robert Bahr
*Attorney, Agent, or Firm*—Ladas & Parry

[57] ABSTRACT

A retarding device for an exerciser includes a tubular housing, a drive shaft extending axially into the tubular housing and being movable axially therein, and a plurality of friction plates provided in the tubular housing and in contact with the drive shaft so as to resist axial movement of the drive shaft in the tubular housing. The tightness of contact between the friction plates and the drive shaft can be varied so as to vary correspondingly resistance to axial movement of the drive shaft.

5 Claims, 7 Drawing Sheets

RETARDING DEVICE FOR AN EXERCISER

BACKGROUND OF THE INVENTION

1. Field of the Invention

The invention relates to a retarding device for an exerciser, more particularly to a retarding device which can replace conventional hydraulic cylinders used in exercisers.

2. Description of the Related Art

Conventional exercisers usually incorporate a hydraulic cylinder unit to serve as a retarding device therefor. Referring to FIGS. 1 and 2, a conventional hydraulic stepper is shown to comprise an L-shaped frame (1) and two pedal units (2) hinged respectively on two sides of the frame (1). A hydraulic cylinder (3, 4) is provided on top of each of the pedal units (2). Each of the hydraulic cylinders (3, 4) has one end hinged to the frame (1) and a piston shaft (3*a*, 4*a*) connected to the respective pedal unit (2). A fluid path (6) interconnects the hydraulic cylinders (3, 4). When pressure is applied so as to move a first one of the pedal units (2) downward, the first one of the pedal units (2) pivots about a pin (1*a*) on the frame (1), thereby pushing the piston shaft (3*a*) of the corresponding hydraulic cylinder (3) further into the cylinder body, as best illustrated in FIG. 2. Hydraulic oil (5) in the hydraulic cylinder (3) flows out of the latter and is transferred to the other hydraulic cylinder (4) via the fluid path (6). The piston shaft (4*a*) of the other hydraulic cylinder (4) is pushed downward, thereby causing a second one of the pedal units (2) to pivot upwardly. This illustrates how reciprocating movement of the pedal units (2) is achieved in the conventional hydraulic stepper. The main drawbacks of using hydraulic cylinder units as the retarding device in an exerciser are as follows:

1. Leakage of hydraulic oil in the hydraulic cylinder units can easily occur, thus hindering the proper operation of the exerciser.

2. The hydraulic cylinder units are relatively expensive, thereby increasing the cost of the exerciser.

SUMMARY OF THE INVENTION

Therefore, the main object of the present invention is to provide a retarding device which is simple in construction and which can replace conventional hydraulic cylinders used in exercisers.

Another object of the present invention is to provide a retarding device which is relatively inexpensive and which can generate resistance so as to retard movement of the movable parts of an exerciser.

According to this invention, a retarding device for an exerciser includes a tubular housing, a drive shaft, a tubular support member, a plurality of movable friction plates and an adjustment unit. The tubular housing has an open top end. The drive shaft extends axially into the tubular housing and is movable axially therein. The tubular support member has an outer surface and is secured in an intermediate part of the tubular housing. The movable friction plates are provided in the tubular housing and supported on top of the support member. Each of the friction plates has a rear wedge surface and a front surface which is in contact with the drive shaft so as to resist axial movement of the drive shaft in the tubular housing. The adjustment unit includes a tubular cap which is mounted on the open top end of the tubular housing and which is movable in an axial direction with respect to the tubular housing, and a plurality of movable driving plates. Each of the driving plates has a front wedge surface which abuts and complements the rear wedge surface of a respective one of the friction plates, and a rear surface which abuts an inner wall surface of the tubular housing. The driving plates are coupled with the tubular cap in such a manner that axial movement of the tubular cap causes corresponding axial movement of the driving plates. The inner wall surface of the tubular housing and the outer surface of the support member cooperatively define a clearance therebetween so as to permit the driving plates to extend in the clearance when varying tightness of contact between the friction plates and the drive shaft, thereby varying correspondingly resistance to axial movement of the drive shaft.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
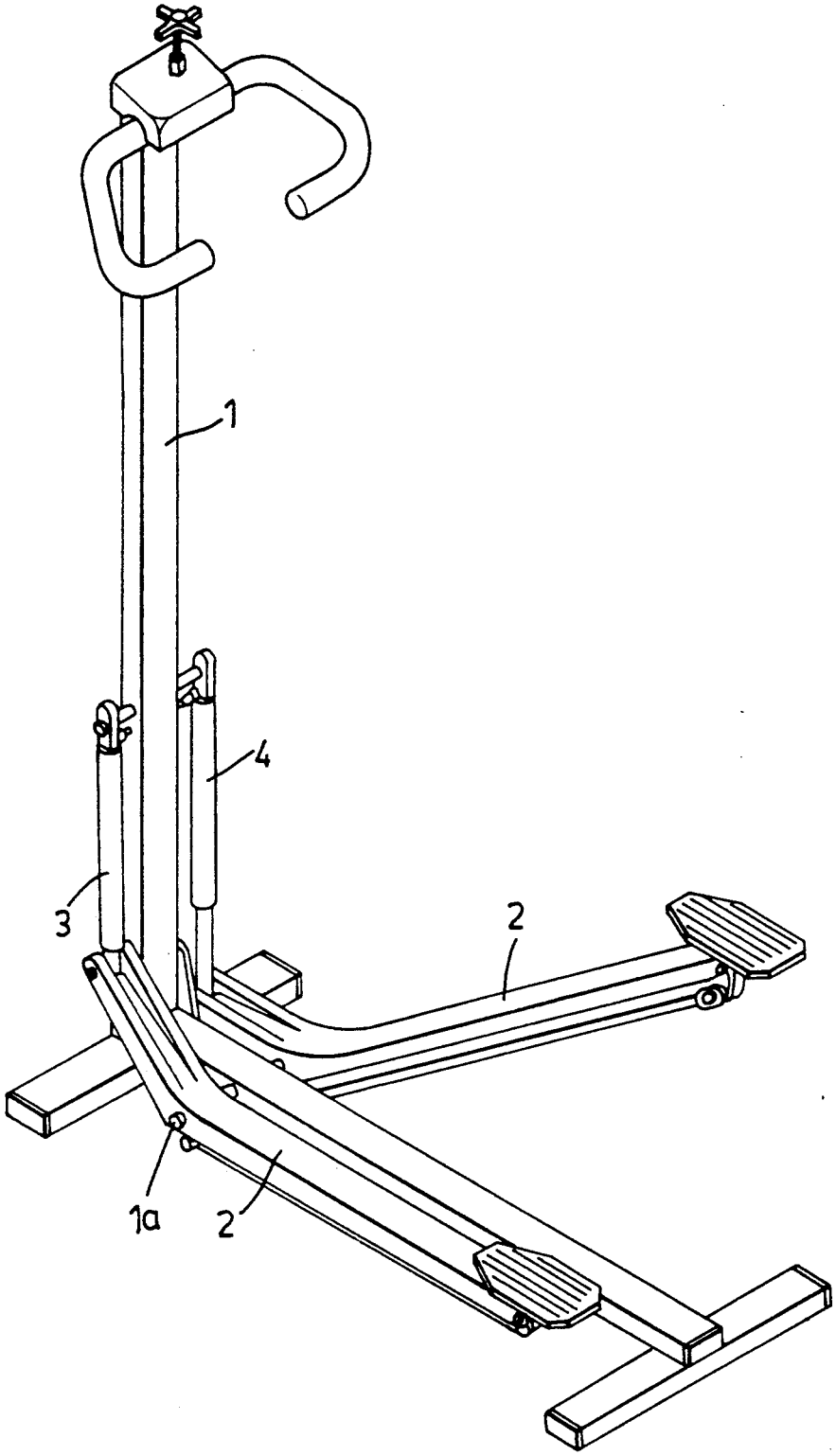
FIG.1 PRIOR ART
FIG. 1 is a perspective view of a conventional hydraulic stepper.
Figure 2:
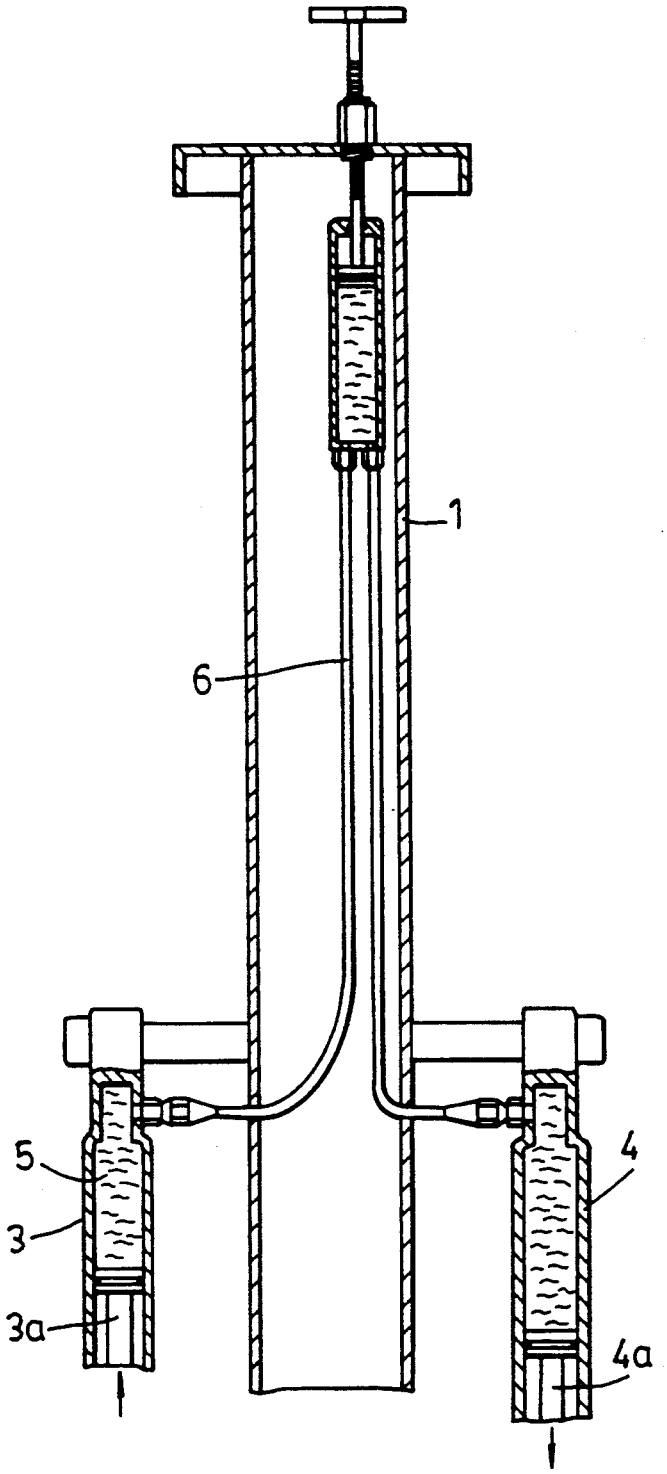
FIG.2 PRIOR ART
FIG. 2 is a fragmentary sectional view which illustrates the operation of the conventional hydraulic stepper shown in FIG. 1.
Figure 3:
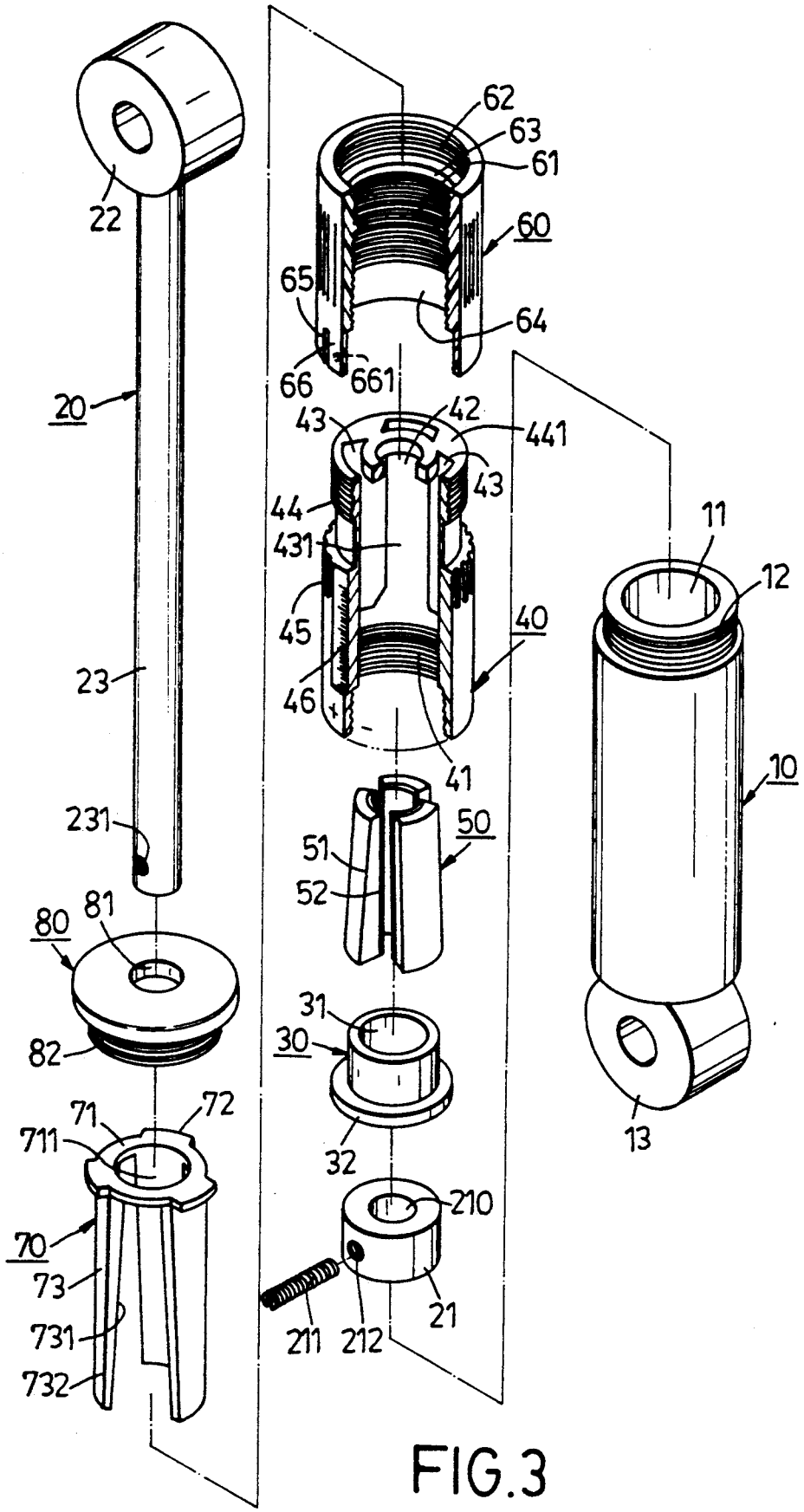
FIG. 3 is an exploded view of the first preferred embodiment of a retarding device according to the present invention.

Referring to FIG. 3, the first preferred embodiment of a retarding device according to the present invention is to be used in an exerciser and includes a tubular housing with a mounting part (10) and a connecting part (40), a drive shaft (20), a tubular support member (30), a plurality of movable friction plates (50), an adjustment unit, and a top cap member (80).

The mounting part (10) confines a receiving space (11) and has an open top end (12) that is threaded externally. The bottom of the mounting part (10) is formed with a coupling ring (13) so as to couple with an appropriate part of the exerciser (not shown).

The drive shaft (20) includes a thin cylindrical shaft (23) which has a lower end that is formed with a diametrically extending threaded hole (231). An enlarged cylindrical limit piece (21) is formed with an axial through hole (210) and a diametrically extending threaded hole (212). The lower end of the cylindrical shaft (23) extends into the through hole (210) of the limit piece (21) and is fastened thereto by means of a screw fastener (211) which engages threadably the holes (212,231). The cylindrical shaft (23) extends into the receiving space (11) and has a top end which is formed with a coupling ring (22) so as to couple with an appropriate part of the exerciser (not shown).

The tubular support member (30) is formed with an axial through hole (31) through which the cylindrical shaft (23) extends and has an annular flange (32) that projects radially outward from a lower end thereof. The flange (32) of the support member (30) rests on the open top end (12) of the mounting part (10) of the tubular housing so as to restrict movement of the limit piece (21) in the receiving space (11).

Figure 4:
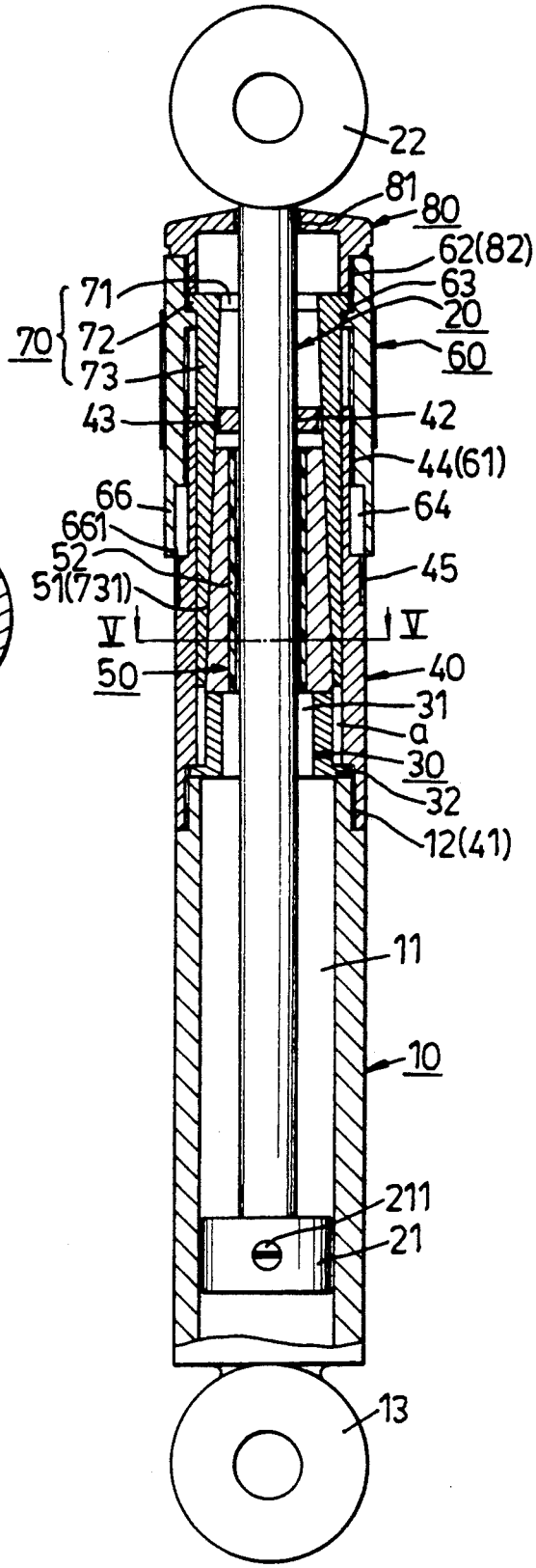
FIG. 4 is a sectional view of first preferred embodiment.

The connecting part (40) has an open bottom end (41) that is threaded internally and an open top end (44) that is threaded externally. The open bottom end (41) of the connecting part (40) engages threadably the open top end (12) of the mounting part (10) in such a manner that an outer portion of the flange (31) of the support member (30) is clamped between the connecting part (40) and the mounting part (10). The outer surface of the support member (30) and an inner wall surface of the connecting part (40) cooperatively define a clearance (a) therebetween, as best illustrated in FIG. 4. The open top end (44) of the connecting part (40) has an annular flange (441) projecting radially inward therefrom so as to confine a central hole (42) thereat. The central hole (42) of the flange (441) of the connecting part (40) permits the extension of the cylindrical shaft (23) therethrough. A plurality of positioning slots (43) are formed radially in the annular flange (441). The inner wall surface of the connecting part (40) has a plurality of axially extending and angularly spaced guide grooves (431) formed therein. Each of the guide grooves (431) extends downwardly from a respective one of the positioning slots (43). A plurality of axially extending and angularly spaced slits (45) are formed in the outer surface of the connecting part (40). Graduations (46) are provided axially at an appropriate position on the outer surface of the connecting part (40).

The movable friction plates (50) are provided in the tubular housing and are supported on top of the support member (30). Each of the friction plates (50) has a rear wedge surface (51) and a front surface which has a rubber pad (52) attached adhesively thereto and which is in contact with the drive shaft (20) so as to resist axial movement of the drive shaft (20) in the tubular housing.

The adjustment unit includes a tubular cap (60) that is mounted on the open top end (44) of the connecting part (40) of the tubular housing. Both the upper end portion (62) and the intermediate portion (61) of the tubular cap (60) are threaded internally. An annular flange (63) projects radially inward from an inner wall surface of the tubular cap (60) between the upper end portion (62) and the intermediate portion (61) of the tubular cap (60). The lower end portion (64) of the tubular cap (60) has two axially spaced extending slits (65) formed therein so that the slits (65) cooperatively define a resilient leaf (66) therebetween. A protrusion (661) protrudes from an inner surface of the resilient leaf (66). The adjustment unit further includes a plurality of movable driving plates (73) that extend downward from an annular plate (71). The annular plate (71) is formed with a central hole (711) and has a plurality of projections (72) that project radially outward therefrom. Each of the driving plates (73) has a front wedge surface (731) which abuts and complements the rear wedge surface (51) of a respective one of the friction plates (50) and has a rear surface (732) which abuts the inner wall surface of the connecting part (40) of the tubular housing. The driving plates (73) extend through the tubular cap (60) and through the corresponding positioning slots (43) of the connecting part (40). The projections (72) rest on the flange (63) of the tubular cap (60) so as to prevent downward movement of the driving plates (73) relative to the tubular cap (60). The clearance (a) permits the driving plates (73) to extend therein when varying tightness of contact between the friction plates (50) and the drive shaft (20).

The top cap member (80) is formed with a central through hole (81) which permits the extension of the cylindrical shaft (23) therethrough. The top cap member (80) has a lower part (82) which is threaded externally so as to engage the upper end portion (62) of the tubular cap (60) in order to prevent upward movement of the driving plates (73) relative to the tubular cap (60).

Referring to FIGS. 4 to 8, assembly of the first preferred embodiment is as follows: After the cylindrical shaft (23) is extended through the central through hole (81) in the top cap member (80), the central hole (711) in the annular plate (71), the tubular cap (60), the central hole (42) in the connecting part (40), the axial through hole (31) of the support member (30), and the axial through hole (210) of the limit piece (21), the limit piece (21) is then fastened to the lower end of the cylindrical shaft (23) by means of the screw fastener (211). The lower end of the cylindrical shaft (23) is extended into the receiving space (11) of the mounting part (10) of the tubular housing. The friction plates (50) are inserted into the connecting part (40) through the open bottom end (41). The open bottom end (41) of the connecting part (40) is then engaged threadably with the open top end (12) of the mounting part (10) so that the flange (32) of the support member (30) is clamped between the connecting part (40) and the mounting part (10) and so that the friction plates (50) are supported on top of the support member (30). The driving plates (73) are extended through the positioning slots (43) and are received in the grooves (431) on the inner wall surface of the connecting part (40) in such a manner that the front wedge surface (731) of the driving plates (73) abut and complement the rear wedge surface (51) of the friction plates (50) and such that the projections (72) of the annular plate (71) rest on the flange (63) of the tubular cap (60). The intermediate portion (61) of the tubular cap (60) is then engaged threadably with the open top end (44) of the connecting part (40) in such a manner that the tubular cap (60) can be rotated relatively to the connecting part (40). Finally, the lower part (82) of the top cap member (80) is engaged threadably with the upper end portion (62) of the tubular cap (60) so as to clamp the periphery of the annular plate (71) therebetween in order to prevent vertical movement of the driving plate (73) relative to the tubular cap (60).

Figure 5:
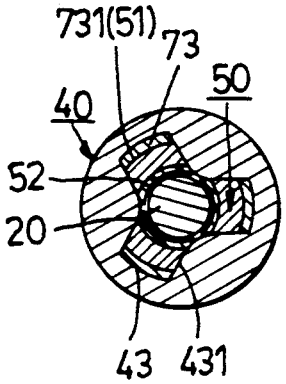
FIG. 5 is a V—V cross section of FIG. 4.

Referring to FIGS. 4 and 5, when the rubber pads (52) of the friction plates (50) are not in tight contact with the cylindrical shaft (23), the cylindrical shaft (23) moves axially within the tubular housing under the presence of minimal resistance. This facilitates ease of initial positioning of the movable parts of the exerciser.

Figure 7:
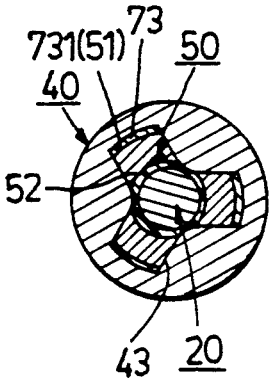
FIG. 7 is a VII—VII cross section of FIG. 6.
Figure 6:
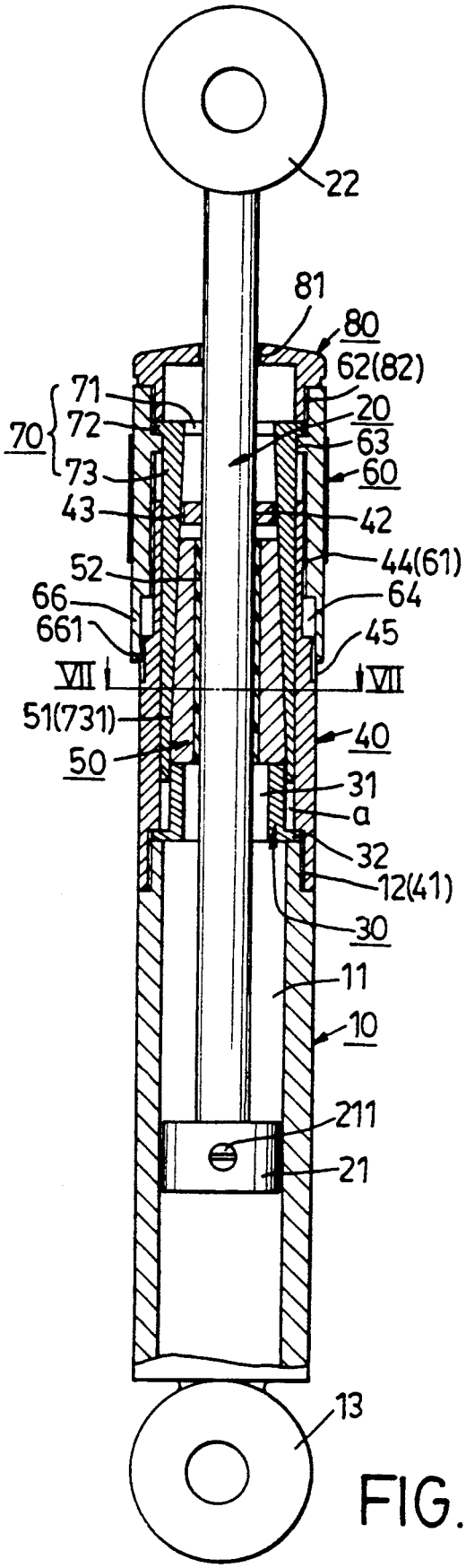
FIG. 6 is a sectional view illustrating the operation of the first preferred embodiment.
Figure 8:
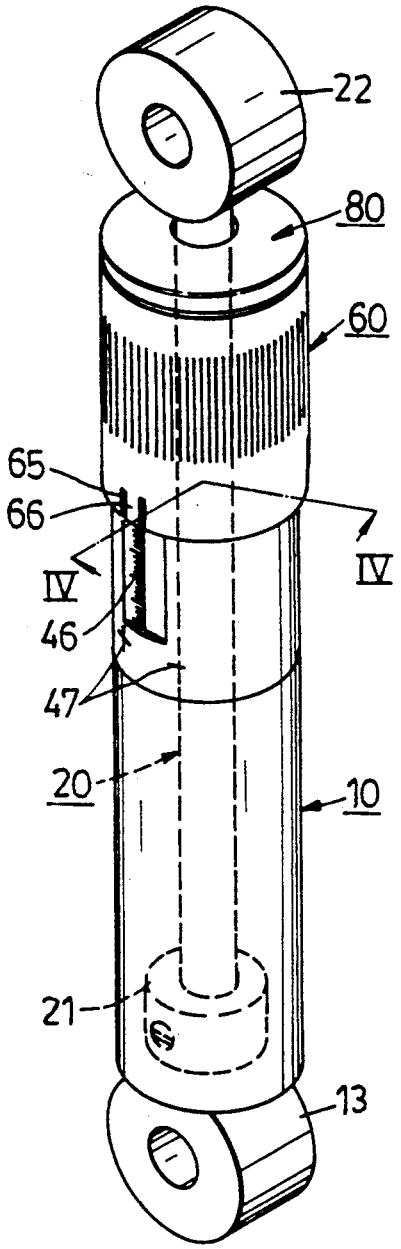
FIG. 8 is a perspective view of the first preferred embodiment.

The resistance to be offered by the retarding device of the present invention should be adjusted so as to correspond with the body weight and the age of the user. Referring to FIGS. 6 and 7, in order to adjust the resistance of the retarding device, the tubular cap (60) is rotated so that the rotation of the tubular cap (60) in one direction is converted into axial movement of the tubular cap (60) so as to cause corresponding axial movement of the driving plates (73). The clearance (a) permits the lower end portion of the driving plates (73) to extend therein when varying tightness of contact between the rubber pad (52) of the friction plates (50) and the cylindrical shaft (23) of the drive shaft (20) in order to vary correspondingly resistance to axial movement of the drive shaft (20).

Referring once more to FIGS. 5 and 8, when adjusting the resistance of the retarding device, the protrusion (661) of the tubular cap (60) moves past certain ones of the slits (45) in the connecting part (40) so that a clicking sound will be generated when the tubular cap (60) is rotated relative to the connecting part (40). Furthermore, the lowermost end of the tubular cap (60) is made to correspond with the graduations (46) on the outer surface of the connecting part (40). This facilitates the adjustment of the retarding device so as to obtain the desired amount of resistance therefrom.

Figure 9:
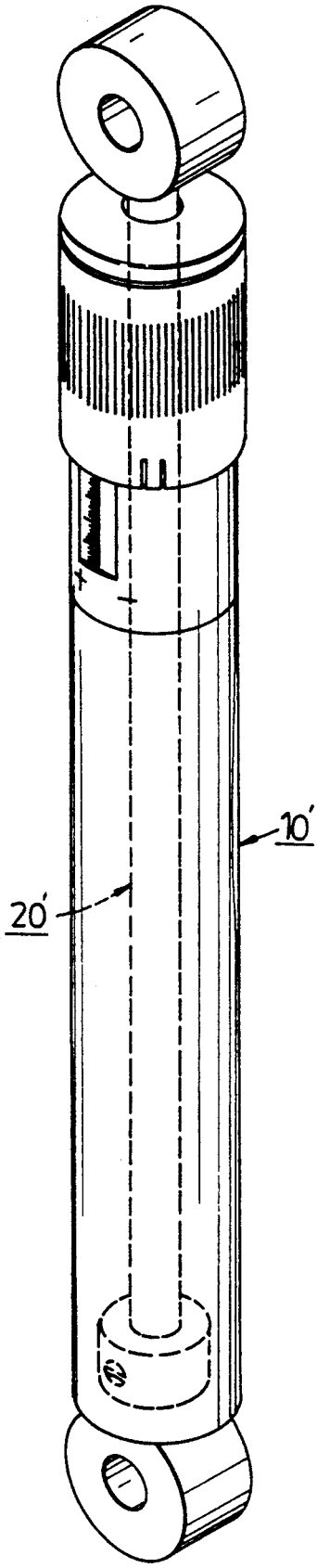
FIG. 9 is a perspective view of the second preferred embodiment of the retarding device according to the present invention.

The second preferred embodiment of a retarding device according to the present invention is shown in FIG. 9. Unlike the first preferred embodiment, the lengths of the mounting part (10') and the drive shaft (20') are increased to increase correspondingly the length of the retarding device. Therefore, the retarding device can custom fit various exercisers by selecting the proper lengths of the mounting part and the drive shaft, thereby reducing the cost of the exerciser.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A retarding device for an exerciser, comprising:

a tubular housing having an open top end;

a drive shaft extending axially into said tubular housing and being movable axially therein;

a tubular support member which has an outer surface and which is secured in an intermediate part of said tubular housing;

a plurality of movable friction plates provided in said tubular housing and supported on top of said support member, each of said friction plates having a rear wedge surface and a front surface which is in contact with said drive shaft so as to resist axial movement of said drive shaft in said tubular housing; and an adjustment unit including a tubular cap which is mounted on said open top end of said tubular housing and which is movable in an axial direction with respect to said tubular housing, and a plurality of movable driving plates, each of which having a front wedge surface which abuts and complements said rear wedge surface of a respective one of said friction plates, each of said driving plates further having a rear surface which abuts an inner wall surface of said tubular housing, said driving plates being coupled with said tubular cap in such a manner that axial movement of said tubular cap causes corresponding axial movement of said driving plates, said inner wall surface of said tubular housing and said outer surface of said support member cooperatively defining a clearance therebetween so as to permit said driving plates to extend in said clearance when varying tightness of contact between said friction plates and said drive shaft, thereby varying correspondingly resistance to axial movement of said drive shaft.

2. A retarding device as claimed in claim 1, wherein said open top end of said tubular housing is threaded externally, said tubular cap having a lower end portion which is threaded internally and which engages threadably said open top end of said tubular housing.

3. A retarding device as claimed in claim 1, wherein said tubular housing includes a mounting part having an open top end which is threaded externally, and a connecting part having an open top end which is threaded externally and an open bottom end which is threaded internally and which engages threadably said open top end of said mounting part, said support member resting on said open top end of said mounting part, said open top end of said connecting part engaging threadably said lower end portion of said tubular cap.

4. A retarding device as claimed in claim 3, wherein said connecting part of said tubular housing has an inner wall surface which is formed with a plurality of axially extending and angularly spaced guide grooves, said guide grooves receiving a respective one of said driving plates so as to guide axial movement of said driving plates.

5. A retarding device as claimed in claim 1, wherein each of said friction plates has a rubber pad attached to said front surface.

* * * * *